United States Patent [19]

Frank

[11] Patent Number: 4,960,987

[45] Date of Patent: Oct. 2, 1990

[54] X-RAY IMAGE INTENSIFIER WITH CONDUCTIVE-COAT ELECTRODES ON INSULATED METAL SIDEWALLS

[75] Inventor: Richard Frank, Erlangen, Fed. Rep. of Germany

[73] Assignee: Siemens Aktiengesellschaft, Berlin and Munich, Fed. Rep. of Germany

[21] Appl. No.: 405,218

[22] Filed: Sep. 11, 1989

[30] Foreign Application Priority Data

Sep. 29, 1988 [EP] European Pat. Off. ..... 88116129.3

[51] Int. Cl.[5] ..... H01J 31/50; H01J 29/88

[52] U.S. Cl. ..... 250/213 VT; 313/389

[58] Field of Search ..... 250/213 VT; 313/382, 313/383, 389, 390, 529, 537

[56] References Cited

U.S. PATENT DOCUMENTS

| | | | |
|---|---|---|---|
| 2,151,785 | 6/1938 | Lubszynski et al. | 313/524 |
| 3,225,204 | 12/1965 | Schagen et al. | 313/390 |
| 3,417,242 | 12/1968 | Windebank et al. | 250/367 |
| 3,688,146 | 8/1972 | Bouwers | 313/496 |
| 4,169,239 | 8/1979 | Ehata et al. | 313/389 |

OTHER PUBLICATIONS

"Insulating Aluminumoxide Films," Mohr et al., IBM Technical Disclosure Bulletin, vol. 6, No. 3, Aug. 1963.

"Das Roentegenfernsehen," Gebauer et al., 1974, pp. 54–57.

*Primary Examiner*—David C. Nelms

*Assistant Examiner*—George Beck

*Attorney, Agent, or Firm*—Hill, Van Santen, Steadman & Simpson

[57] ABSTRACT

An x-ray image intensifier for use in an x-ray diagnostic system has an electrode system for focusing electrons generated by incident x-radiation on an input luminescent screen onto an output luminescent screen. For reducing manufacturing and assembly costs, the electrodes of the electrode system are applied as a coat on the inside of a one-piece sheet metal part which forms the wall of the x-ray image intensifier between the input and output luminescent screens. The coat is adapted in shape as needed to form the electrodes, and the sheet metal wall, with the electrodes thereon, has different diameters along its longitudinal length matched to the required electrode diameters.

3 Claims, 1 Drawing Sheet

X-RAY IMAGE INTENSIFIER WITH CONDUCTIVE-COAT ELECTRODES ON INSULATED METAL SIDEWALLS

BACKGROUND OF THE INVENTION

1. Field of the Invention

The present invention is directed to an x-ray image intensifier of the type used in an x-ray imaging system, such as for medical diagnostics.

2. Description of the Prior Art

X-ray image intensifiers are used in x-ray diagnostics systems to convert an x-ray shadow image, produced by transillumination of a patient with x-rays, into a visible image. A video camera tube is connected to the output screen of the x-ray image intensifier, and supplies signals corresponding to the output of the x-ray image intensifier to a video monitor, via a video chain. The examination area is displayed on the monitor as a viewable image.

An x-ray image intensifier is disclosed in U.S. Pat. No. 3,688,146 having a tubular evacuated vessel with an input luminescent screen with a photo-cathode situated at one end face thereof, and having an electrode system, for accelerating and focusing the electrons which are generated upon incidence of x-radiation on the input luminescent screen, onto an output luminescent screen, arranged at the other end face. The electrode system has a plurality of cylindrical or annular electrodes of different diameters, to which respectively different voltages are applied for focusing the electrons generated at a point of the input luminescent screen onto a corresponding point of the output luminescent screen. These electrodes are applied to the inside of the tubular wall of the x-ray image intensifier as a metal coat over areas having different diameters. The tubular wall consists of insulting material. A conductor is fed through the tubular wall for voltage supply to the electrodes, and is in electrical contact with the metallic coat.

SUMMARY OF THE INVENTION

It is an object of the present invention to provide an x-ray image intensifier having a structure such that manufacturing costs for the x-ray intensifier are reduced.

The above object is achieved in an x-ray image intensifier wherein the x-ray image intensifier wall, between the input luminescent screen and the output luminescent screen (or at least between the input luminescent screen and a glass holder for the output luminescent screen) is a one-piece sheet metal part. The electrodes of the x-ray image intensifier are applied as a coat to the one-piece sheet metal part with an insulating layer disposed between, and cover selected regions as needed for the operation of the electrodes. The sheet metal wall, and thus the electrodes thereon in the form of a coat, have different diameters over the longitudinal length of the wall which are matched to the required electrode diameters.

An advantage of the invention is that the electrodes are applied as a coat on the inside of the one-piece wall of the x-ray image intensifier, between the input and output luminescent screens. The manufacture of the electrode system is thus significantly simplified, because mounts for the electrodes, and thus the adjustment thereof, within the evacuated vessel are eliminated. The assembly outlay and manufacturing costs are reduced as a result. Moreover, the surface of the electrodes is reduced, which has a positive influence on the stability of the high vacuum within the interior of the x-ray image intensifier. The surface of the electrodes is reduced because the electrodes are applied as a thin coat on the interior wall of the x-ray image intensifier, and thus only the inward, facing surface of the coat can degrade the vacuum, by atoms outgassing from the coat.

The individual electrodes forming the electrode system are thus created simultaneously in one coating step, thereby reducing the manufacturing costs and assembly outlay.

DESCRIPTION OF THE PREFERRED EMBODIMENTS

Figure 1:
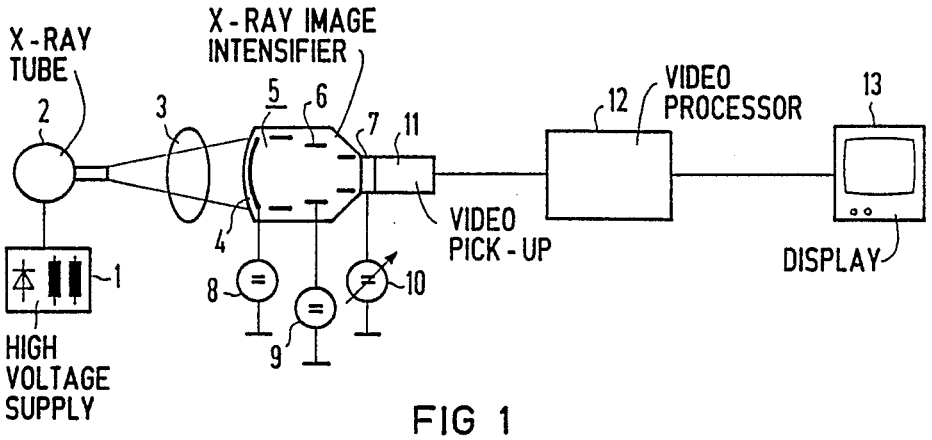
FIG. 1 is a schematic block diagram showing an x-ray diagnostics installation in which an x-ray image intensifier constructed in accordance with the principles of the present invention can be used.

A typical x-ray diagnostics installation is shown in FIG. 1, of the type in which an x-ray image intensifier constructed in accordance with the principles of the present invention can be used. The x-ray diagnostics installation of FIG. 1 includes a high voltage supply 1 which feeds an x-ray tube 2, which generates an x-ray beam in which a patient 3 is situated. Radiation attenuated by the patient 3 is incident on an input luminescent screen 4 of an x-ray image intensifier 5. Electrons emerging as a result from the input luminescent screen 4 are focused onto an output luminescent screen 7 of the x-ray image intensifier 5 by electrodes of an electrode-optics system 6. Voltage sources 8, 9 and 10 supply the electrodes of the x-ray image intensifier 5 with the required acceleration and deflection voltages. A standard video chain including an image pick-up 11 and a video processor 12 and a display 13 is connected to the output of the x-ray image intensifier 5. The x-ray shadow image produced by the patient 3 on the input screen can thus be portrayed as a viewable image on the screen of the display 13, by the operation of the x-ray image intensifier 5 and video chain.

Figure 2:
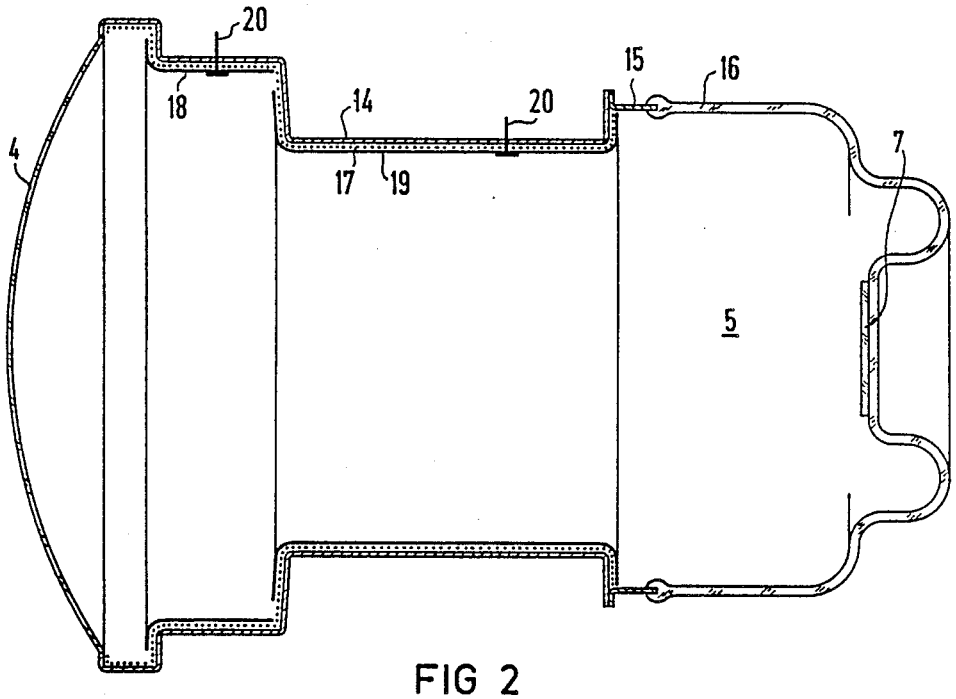
FIG. 2 is a side sectional view of an x-ray image intensifier constructed in accordance with the principles of the present invention.

A embodiment of an x-ray image intensifier 5 constructed in accordance with the principles of the present invention, in sectional view, is shown in FIG. 2. Elements of FIG. 2 which are identical to those of FIG. 1 are identified with the same reference number.

The x-ray image intensifier 5 of FIG. 2 has a cylindrical wall formed by a one-piece electrode carrier 14, shaped from a single piece of sheet metal. The one-piece electrode carrier 14 is attached to the input luminescent screen 4, and is fused to a glass wall 16 of a glass carrier for the output luminescent screen 7 by a fastening flange 15. An insulating layer 17 is applied on the inside of the electrode carrier 14. The thickness of the insulating layer 17 is dependent upon the required operating voltage of the electrodes, which thereby determines the dielectric strength which the insulating layer 17 must have. The insulating layer 17, for example, may be a lacquer, ceramic, glass or, preferably, a metal oxide such as aluminum oxide or aluminum-titanium oxide. The insulating layer 17 is applied with a spraying process such as, for example, plasma spraying or spray painting.

An electrically conductive coat is applied over the insulating layer 17 at selected regions of the interior of the electrode carrier 14, so that electrodes 18 and 19 are formed. The conductive coat forming the electrodes 18 and 19 can be applied on corresponding regions of the insulating layer 17 of the x-ray image intensifier 5 by painting, or with a spraying process such as, for example, plasma spraying. It is also possible to apply the coat forming the electrodes 18 and 19 to the entire interior surface of the electrode carrier 14, i.e., on the entirety of the insulating layer 17, and then to remove a selected region by grinding, for example, so that the electrodes 18 and 19 are formed.

A conductor for each electrode 18 and 19 is fed through the electrode carrier 14 and is in electrical contact with the conductive coat forming the respective electrodes 18 and 19. Voltage sources as shown in FIG. 1 can be connected to the conductor 20 for appropriate voltage supply to the electrodes 18 and 19.

In the embodiment of FIG. 2, an image intensifier 5 has been shown having two electrodes 18 and 19. It is possible within the framework of the invention, however, to provide further electrodes and to correspondingly fashion the shape of the electrode carrier. In the embodiment of FIG. 2, the electrode carrier 14 has a stepped cross section, so that the respective electrodes 18 and 19 have the required diameters. It is also possible, however, to construct the electrode carrier 14 in a conical shape. The electrodes can then still be formed by an electrically conductive coat applied to a one-piece electrode carrier.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray image intensifier comprising:

an x-ray-sensitive input luminescent screen;

an output luminescent screen;

a one-piece sheet metal wall having opposite ends respectively closed by said input luminescent screen and said output luminescent screen;

an insulating layer covering the inside of said sheet metal wall; and an electrode system adapted for connection to external voltages for focusing electrons generated by the incidence of x-radiation on said input luminescent screen onto said output luminescent screen, said electrode system consisting of a plurality of electrodes formed by a conductive coat applied over selected regions of said insulating layer on said one-piece sheet metal wall.

2. An x-ray image intensifier as claimed in claim 1, wherein said insulating layer consists of aluminum oxide.

3. An x-ray image intensifier as claimed in claim 1, wherein said insulating layer consists of aluminum-titanium oxide.

* * * * *